US005338036A

United States Patent [19]

Takeuchi et al.

[11] Patent Number: 5,338,036

[45] Date of Patent: Aug. 16, 1994

[54] GOLF EXERCISING AID DEVICE

[75] Inventors: Hiromasa Takeuchi; Toshihiko Iwatani; Takumi Yamaguchi, all of Osaka, Japan

[73] Assignee: Universal System Control, Inc., Osaka, Japan

[21] Appl. No.: 52,448

[22] Filed: Jun. 9, 1993

[51] Int. Cl.[5] ..... A63B 69/36

[52] U.S. Cl. ..... 273/187.2

[58] Field of Search ..... 273/187.2

[56] References Cited

U.S. PATENT DOCUMENTS

| | | | |
|---|---|---|---|
| 3,362,023 | 1/1968 | McMahon | 273/187.2 X |
| 4,193,065 | 3/1980 | Bittner | 273/187.2 X |
| 4,392,830 | 7/1983 | Salzman et al. | 273/187.2 X |
| 4,502,035 | 2/1985 | Obenauf et al. | 273/187.2 X |
| 4,527,982 | 7/1985 | Salzman et al. | 273/187.2 X |
| 5,087,047 | 2/1992 | McConnell | 273/187.2 |
| 5,221,088 | 6/1993 | McTeigue et al. | 273/187.2 |
| 5,251,902 | 10/1993 | Federowicz et al. | 273/187.2 |

FOREIGN PATENT DOCUMENTS 1257049 10/1989 Japan .

OTHER PUBLICATIONS

Japanese Pamphlet, entitled "Head up Trainer", by Universal System Control, Inc.

*Primary Examiner*—William H. Grieb

*Attorney, Agent, or Firm*—Thompson, Hine and Flory

[57] ABSTRACT

A simple golf exercising aid device for notifying a golf player immediately after any head-up. The device comprises sound pickup means for an impacting sound caused by the impact of a club head against a golf ball, first means which compares, with a threshold value, a waveform within a predetermined frequency band out of the signals provided by the sound pickup means and outputs the result after a predetermined delay time, a motion sensor made up of an earth magnetic field sensor or an angular velocity sensor, for converting the motion of a golf player's head into an electrical signal, and second means which rectifies and then differentiates the output signal of said motion sensor, and which compares the differentiated output with a threshold value. Said motion sensor is mounted a portion of the golf player's head, and judgment output is provided when the timings of the outputs from the two means agree.

9 Claims, 4 Drawing Sheets

GOLF EXERCISING AID DEVICE

BACKGROUND OF THE INVENTION

1. Field of the Invention

The present invention is directed to an electronic device used for golf exercising. When golf players swing with this device set on any part of their body, particularly head, they will be notified of any degree of head-up at the moment the device detects so that players may correct head-up.

2. Description of the Prior Art

Novices have been taught that giving up head-up habit is the shortest way to become a good golf player. Head-up-free swing may stabilize the resulting orbit of a golf ball, and thus stabilizes golf scores, thereby leading to dramatic improvements in golfing skills. It is not easy for players who actually themselves swing to know whether they are now in a position of head-up, except that head-up is so overly made that players feel it. The player usually attributes a poor shot to some degree of head-up with no actual supporting data.

A commonly used method is to video-tape the player's own golf swing for later analysis in an attempt to correct head-up. If the player attempts to analyze swing form, however, on-the-spot analysis and form correction may be difficult. If a method is not readily available for form correction in a duration within which the player's feel after a swing persists, that method may not be very useful. Furthermore, to detect slight degree of head-up, a special video equipment would be needed.

SUMMARY OF THE INVENTION

The head-up is defined as a golf player's form in which the head of the golf player slightly wobbles immediately before a golf ball is impacted. The player then fails to attain accurate follow-through, subsequently unable to hit the ball in the direction the player wanted to go. The head is already in the course of acceleration motion immediately before the impact on the golf ball. The head-up is particularly likely to place when a full swing is tried. Novices tend to start head-up earlier and ends it later; on the other hand, skilled golf players keep their head stable immediately before and after the impact, and after the impact, the skilled players turn their head swiftly as if they followed the orbit of the ball. Observing this physical movement of the head of the player, the inventor has learned that the relationship between the impact and the acceleration motion of the player's head, if detected, makes it possible to immediately determine whether the player. has done head-up or not.

The present invention is based on the above concept. It is the primary object of the present invention to provide a simple golf-exercising aid device which notifies a golf player of any head-up immediately after an golf ball is impacted.

It is another object of the present invention to provide a device which electronically monitors the motion of the player body and makes proper judgments using resulting signals as data for judgment.

It is a further object of the present invention to provide a device which is designed not to restrict a player's swinging motion when the player wears it by making each component of the device compact.

To achieve the above objects, the present invention comprises sound pickup means for picking up impacting sound and first means which compares, with a threshold value, a waveform within a predetermined frequency band out of the signals provided by the sound pickup means and outputs result after a predetermined delay time. The present invention further comprises a motion sensor which converts the motion of the player's head into an electrical signal, and second means used in parallel with the first means, wherein the second means rectifies and then diferentiates the output signal of the motion sensor, followed by comparison process with a threshold value. The motion sensor is mounted on a portion of the player's head, and judgment output is provided only when the output of the first means agrees with the output of the second means in timing.

The impacting sound detected by the sound pickup means functions as a timing signal for determining the timing of the occurrence of the head-up. Why the judgment signal is delayed is that some delay is involved for sound to travel from the position of impact to the sound pickup means; the motion of the player is slow in comparison with the speed of electric processing; and the judgment timing is designed to be adjustable depending on the skill level of players from novices to advanced golf players. The output of the motion sensor is differentiated after it is rectified, because the envelope of the output of the motion sensor varies very mildly thereby presenting a difficulty in determining a timing. To easily detect any rate of change, the present invention includes differentiation process. With a differentiating circuit included, the output voltage is automatically offset. Since the motion sensor's function is to detect the motion of the head of the player, the player must mount it on the head. Although the timing of the start of the head-up different from player to player, novices tend to raise head earlier. This is taken into account in the detecting of the timing in the present invention.

These and other objects, construction, and advantages of the present invention will be apparent from the following description and the accompanying drawings.

DETAILED DESCRIPTION OF THE PREFERRED EMBODIMENTS

Figure 1:
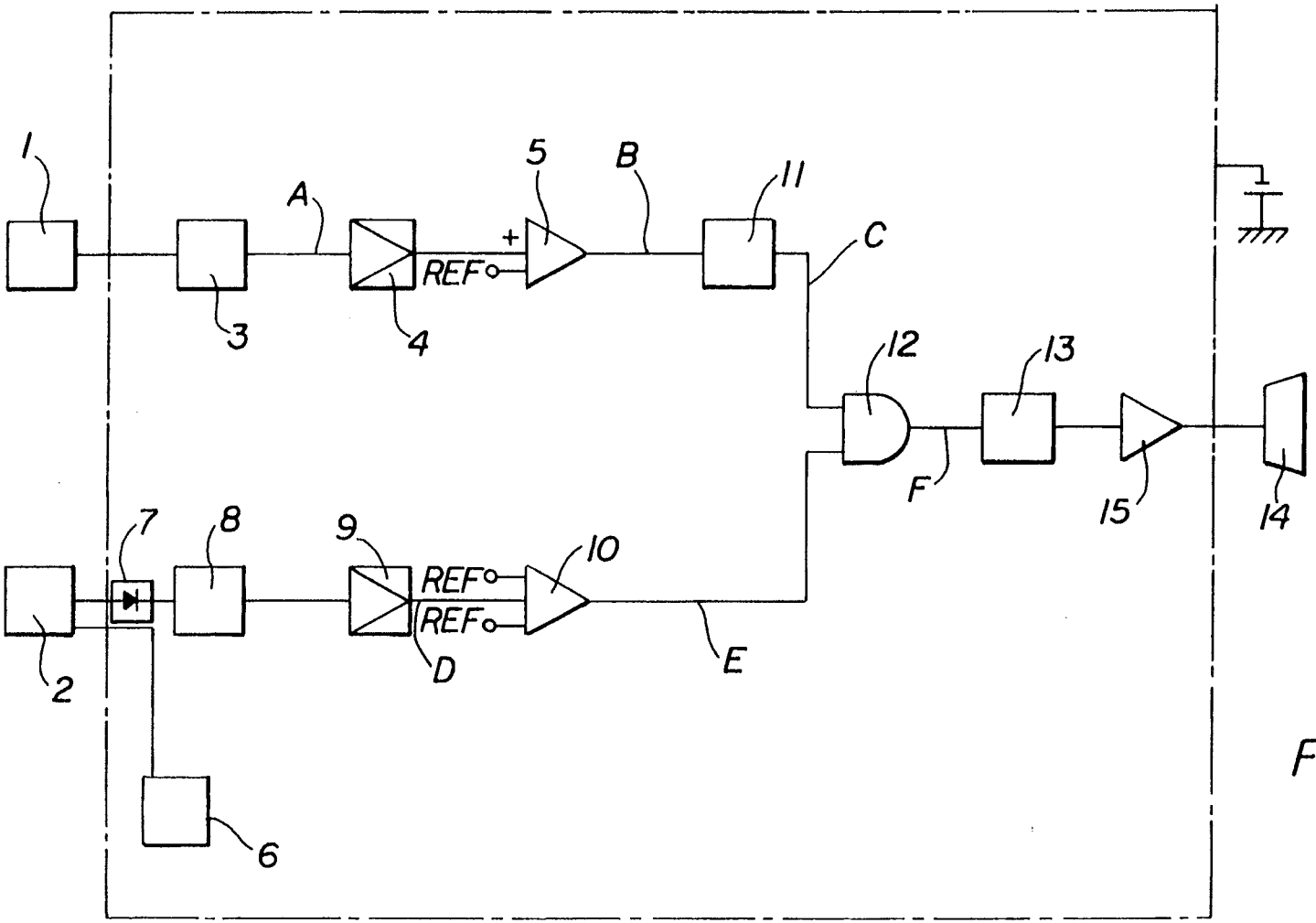
FIG. 1 is a block diagram showing the circuit configuration of the device according to the present invention.

Referring now to the accompanying drawings, preferred embodiments are described. FIG. 1 is a block diagram showing an embodiment of the present invention. A microphone 1 is sound pickup means which picks up the impacting sound generated when a club head hits a golf ball. A motion sensor 2 including an earth's magnetic sensor senses the motion of the head as an electric signal. The judgment of head-up is performed by processing the output signals from these two sensing means. After passing through a bandpass filter 3, the output signal of the microphone 1 is amplified at a proper amplification factor by an amplifier 4, and then fed to a comparator 5. At the comparator 5, only components which are above a fixed threshold level are output. The function of the bandpass filter 3 is to filter out strong noise components falling outside the impacting sound in order to accurately judge the timing of head-up. The center frequency of the filter is the impacting sound of the ball hit by the club head, with a predetermined margin allowed with respect to the frequency. First means is composed of the microphone 1 and its associated block components described above plus a time delay circuit 11.

On the other hand, the motion sensor 2 is driven by sine waved signals provided by an oscillator circuit 6. The motion sensor 2 varies its output voltage depending on its own direction and acceleration, that is, its angular velocity. Specifically, the motion sensor 2 comprises coils picking up electromotive force as voltage waveform. The voltage caused by the driving signal is rectified into an envelope by a rectifier 7. The envelope output is differentiated by a differentiator circuit 8, amplified by an amplifier circuit 9, and then fed to a comparator 10. The reason the differentiator circuit is provided is as follows: The motion of the head is relatively mild if head-up takes place. The motion sensor output signal due to the mild motion has naturally mild rising edges and mild falling edges. The differentiator circuit differentiates these mildly changing waveforms to give waveforms reflecting more accurately the motion of the player and to facilitate acquisition of the judgment timing. Second means is composed of the motion sensor 2 and its associated block components.

The outputs from each of the comparators 5 and 10 serve to determine whether the head-up has been done or not. A delay circuit 11 is incorporated in the impacting sound detector side. The delayed output from the delay circuit 11 and the judgment output from the motion sensor 2 are AND gated (AND gate 12). The delay circuit 11 is provided to cover variations of the timing of the head-up. Namely, since the microphone 1 is spaced from the position where the club head impacts against the golf ball, some time delay takes place for the impacting sound to reach the microphone 1 around the head of the player; the motion sensor 2 response in its rising edge responsive to the motion of the head is subjected to a time delay; and the input and output of the amplifier 9 is also subjected to some time delay. The time constant of the delay circuit 11 may be set depending on the skill level ranging from novices to advanced players.

A one-shot multivibrator circuit 13 allows the AND gate 12 to give its output for a predetermined duration of time, causing an output circuit 14 to give alarm. The output circuit 14 is typically sound output means such as a loudspeaker or a buzzer. Alternatively, it may be other means such as light emission means as long as the player can recognize it. The purpose of the one-shot multivibrator 13 is to drive the output circuit 14 for a fixed duration. Since any means which serves this purpose is sufficient, a delay circuit may be an acceptable substitute. Indicated at 15 is an output buffer which may incorporate an oscillator circuit as a driver for a buzzer if the output circuit 14 is the buzzer.

In the present invention, positional consideration is given to particular circuit components relative to the head of the player in particular. The circuit enclosed by the broken line is signal Judgment means. It may be directly mounted on the player or may be left detached from the player; either will do. The motion sensor 2 must be attached to the head of the player because it has to detect the motion of the head. Generally, the position of the microphone 1 is not important as long as it can sense the impacting sound; however, the relationship between the delay timing of the delay circuit 11 and the setup position of the microphone needs some consideration. Experience shows that the larger separation between the source of impacting sound and the microphone 1 the more complicated the setting of the delay time. Therefore, it is recommended that the microphone 1 is set near the motion sensor 2. The output circuit 14 is sufficient as long as it has an output level for the player to be alerted. If the output circuit 14 is a buzzer, its output level is desirably set as low as possible from the standpoint of power consumption. Therefore, the output circuit 14 is preferably placed in the vicinity of the ears of the player. For this purpose, a light-weight condenser microphone is used as the microphone 1, and a light-weight buzzer as the output circuit 14.

Figure 2:
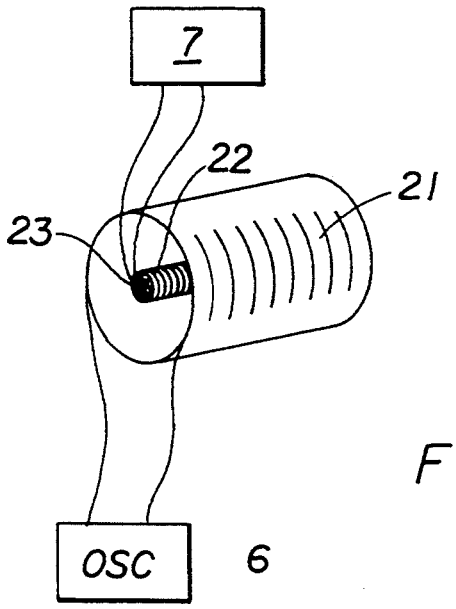
FIG. 2 is a perspective view of an embodiment of a motion sensor.
Figure 3:
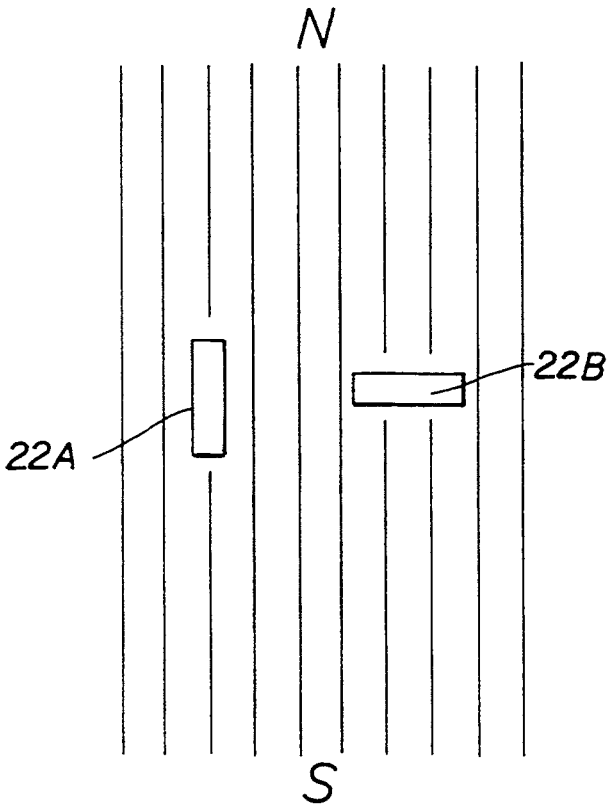
FIG. 3 is a diagram showing an inner coil under the influence of the earth's magnetic field.

FIG. 2 shows an embodiment of the motion sensor 2. The motion sensor comprises two coils, an inner coil 22, an outer coil 21 concentric with the inner coil 22, and a core 23. Spacers of permeable insulator may be disposed as necessary in the space between the outer coil 21 and the inner coil 22. The outer coil 21 is supplied with a high-frequency alternating current by the oscillator circuit 6. Resulting electromotive force is induced in the inner coil 22. The outer coil 21 works as an exciter for the inner coil 22. The electromotive force induced in the inner coil 22 is fed, as a detected output, to the rectifier circuit 7. The voltage waveform of rectified envelope is fed to the differentiator circuit 8. The resulting voltage in the inner coil 22 is affected not only by the induced voltage originated from the outer coil 21 but also by the earth's magnetic field. Specifically, with the earth's magnetic field running from the magnetic north pole to the magnetic south pole as shown in FIG. 3, according to the direction of the inner coil 22, number of lines of magnetic force passing through the core 23, that is, magnetic flux passing through the core 23 changes, causing a difference in resulting electromotive force due to the earth's magnetic field. The electromotive force due to the earth's magnetic field is different between 22A and 22B in FIG. 3, and thus sum of the output voltage including induced voltage from the outer coil 21 differs accordingly. The present invention takes advantage of this difference, detecting the voltage variation due to the position and the motion of the motion sensor 2. Since the differentiator circuit 8 is added to the later stage of the circuit configuration, the output of the rectifier circuit 7 becomes a regulated output voltage when the motion sensor 2 remains completely stationary; thus, the differentiator circuit 8 gives no output. As a result, the detected signal is only the differentiated output corresponding to voltage variations due the physical motion of the motion sensor 2. This means that the motion of the head of the player is the detected signal.

In the present invention, amorphous magnetic material is employed as the core 23 for the inner coil 22. Specifically, the core 23 is made of a bundle of seven amorphous metallic fibers, each 6 mm long and of a diameter of 50 microns. The reason why amorphous magnetic material is used is that the device needs to accurately respond to variations in flux density under the relatively weak magnetic field of the earth. Amorphous magnetic material has a high permeability. It responds to a weak magnetic field while its coercive force is very small. Since amorphous magnetic material has an extremely low residual flux density on its hysterisis curve, it features high sensitivity to a slight change of the earth's magnetic field. Furthermore, amorphous magnetic material's rapid Barkhausen effect serves the purpose of detecting the change of magnetic field. The reasons described above are enough for the inventors to decide the use of amorphous magnetic material. A plurality of amorphous metallic fibers are bundled to obtain a large flux density, while preserving a sensitive response. Namely, a heavy, short fiber segment having a small ratio of diameter to length acquires a larger number of lines of magnetic force while the change of flux density attributable to the directional change of the magnetic field is less pronounced. On the other hand, an elongated fiber segment having a large ratio of diameter to length acquires a smaller number of lines of magnetic force while the change of flux density attributable to the directional change of the magnetic field is more pronounced. Since the present invention makes use of the weak magnetic field of the earth as a measure for detection, consideration is given to the core so that its configuration may allows a sharp response in flux density in response to any directional change. The longer the amorphous metallic fiber the better the response characteristic in the present invention. The device is preferably compact, however, because it has to be attached on the head of the player. The larger the number windings of the outer coil 21 and the inner coil 21 the better the response characteristic. In this embodiment, each coil is made up of double-stranded winding to attain the larger number of winding within its limited longitudinal length. Numerical values quoted here in this embodiment should be interpreted as representative only, and any numerical values which increase the ratio of diameter to length shall be considered within the scope of the present invention.

Figure 4:
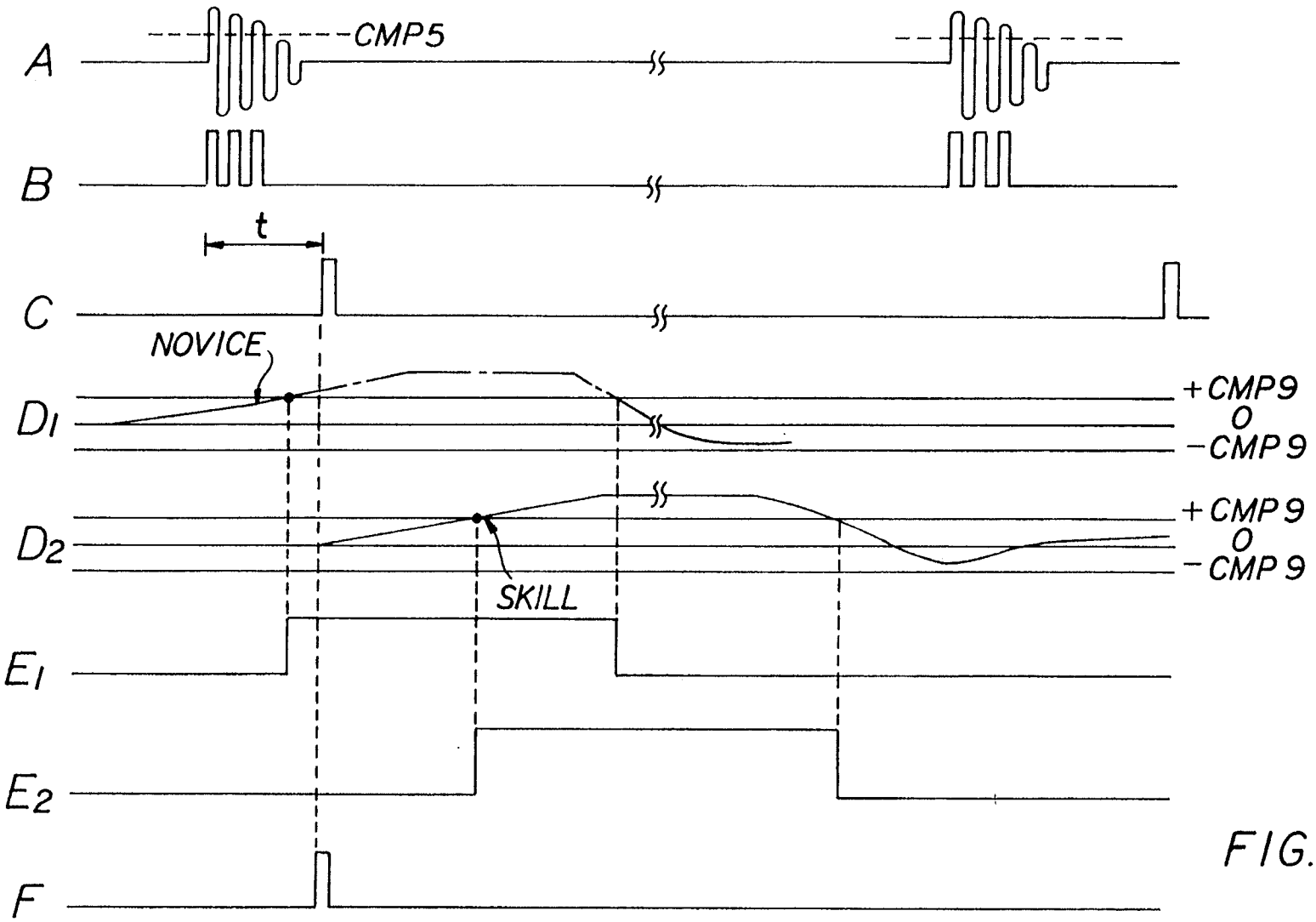
FIG. 4 is a time chart of the circuit used in the device according to the present invention.
Figure 5:
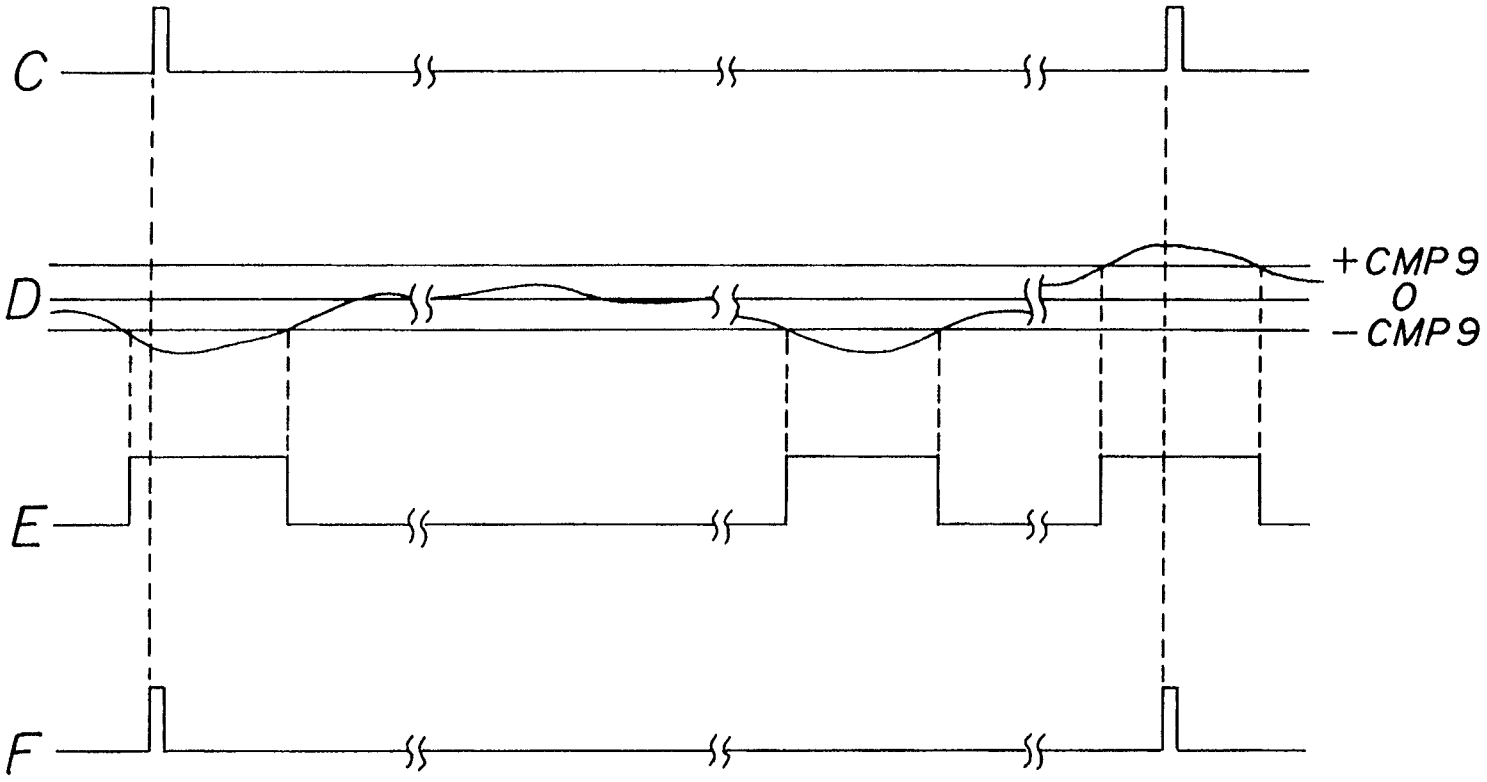
FIG. 5 is a time chart obtained from a player's head motion different from the motion shown in FIG. 4.

Referring to the time charts in FIGS. 4 and 5, the major parts of the circuit of the present invention are now described. The letters A–F in the time charts correspond to the letters A–F in FIG. 1. In FIG. 4, when the microphone 1 picks up an impacting sound, a waveform A with gradually weakening trail is output through the bandpass filter 3. The comparator circuit 5 compares the waveform A with a threshold value (CMP 5), outputting a waveform B. In response to the waveform B, the delay circuit 11 outputs a waveform C of a single pulse after a delay time of t. The output of the motion sensor 2 which is a high frequency waveform in agreement with the oscillation frequency of the oscillator circuit 6 is rectified by the rectifier circuit 7 and an envelope output is provided. The differentiator circuit 8 differentiates the envelope output, resulting in a waveform D. The higher the oscillation frequency of the oscillator circuit 6 the more real the envelope results reflecting the actual change of magnetization. Preferably, the oscillation frequency is somewhere between 10 and 20 MHz. Considering the importance of portability of the device according to the present invention, the device may be driven by batteries. Since the battery operation usually requires low power consumption, the oscillation frequency may sometimes preferably be set lower than quoted above. Even after its differentiation, the waveform D is still a relatively mildly changing curve, because the motion of the head of the player is relatively slow in comparison with the speed of process of electronic devices and because, as an input to the differentiator circuit 8, the envelope of the output given by the rectifier circuit 7 is a very mildly and continuously changing curve. The comparator 10 compares the waveform D with the threshold values (±CMP 9), resulting in a waveform E. The threshold values of the comparator 10 is set to avoid erratic judgment possibly by slight motion of the player. The logical product, a waveform F, of the waveforms C and E thus becomes the output waveform, In the example illustrated in FIG. 4, the device determines that the head-up actually took place because the waveform D1 of the judgment output of the motion sensor 2 exits at the delayed timing of the waveform C. The device then activates the output circuit 14. In contrast, no logical product occurs in case of a waveform D2, and no judgment for head-up is performed. In the waveform D1, the player's head is already set in motion before the club face impacts against the golf ball, and the adverse effect due to the head-up is shown. In the waveform D2, the player's head remains stationary until the impact. The device thus notifies the player of the occurrence of head-up by sound or the like. If the player is a novice, this informs that if they keep the position of head in the same manner as the skilled player, the head-up problem is solved. FIG. 5 shows another time chart, with the output of the differentiator circuit 8 different from that in FIG. 4. The output of the differentiator circuit 8 is negative at some timings, because the mounting of the motion sensor 2 is reverse in fore-front direction, or the motion sensor 2 reversely picks up the head's motion if players hit the golf ball at their left-hand side with the motion sensor 2 set for the right-hand side swing. Basic judgment operations are common to both FIG. 4 and FIG. 5.

The present invention uses, as the timing for judgment, an impacting sound when a golf head impacts against a golf ball, and uses, as the judgment signal, the output signal of a motion sensor after it is differentiated; thus, accurate motion monitoring is possible, and a judgment result is immediately fed back to a golf player. The player can thus feel whether a head raising actually took place or not. The present invention provides a good exercising aid for players. The motion sensor may be shaped to be mounted the head of the player, and the rest of circuitry has a compact design; thus, the entire device may be housed in a single box, achieving compactization.

What is claimed is:

1. A golf exercising aid device comprising sound pickup means for an impacting sound caused by the impact of a club head against a golf ball, first means which compares, with a threshold value, a waveform within a predetermined frequency band out of the signals provided by the sound pickup means and outputs the result after a predetermined delay time, a motion sensor which converts the motion of a golf player's head relative to the earth's magnetic field into an electrical signal, and second means which rectifies and then differentiates the output signal of the motion sensor, and which compares the differentiated output with a threshold value, whereby with said motion sensor attached to a portion of the golf player's head, judgment output is provided when the timings of the outputs from said two means agree.

2. The golf exercising aid device according to claim 1, wherein said sound pickup means is a condenser microphone.

3. The golf exercising aid device according to claim 1, wherein said motion sensor is a sensor comprising an outer coil, an inner coil and the core of the inner coil, with an alternating current applied to the outer coil by an oscillator, the inner coil providing an output voltage, and the core being a bundle of a plurality of metallic fiber made of amorphous magnetic material.

4. The golf exercising aid device according to claim 1, wherein a comparator used as said comparator means in said second means has a comparing voltage on each of the negative and positive sides as a threshold value.

5. The golf exercising aid device according to claim 1, said judgment output passing a delay circuit is then provided by an output circuit.

6. The golf exercising aid device according to claim 5, wherein said delay circuit is a one-shot multivibrator.

7. The golf exercising aid device according to claim 5, wherein said output is provided by activating a buzzer.

8. The golf exercising aid device according to claim 7, wherein said buzzer is placed in the vicinity of an ear of the golf player.

9. The golf exercising aid device according to claim 1, wherein the components of the device is housed in an enclosure which is attached to an ear of the golf player.

* * * * *